US006631858B1

(12) United States Patent
Farineau et al.

(10) Patent No.: US 6,631,858 B1
(45) Date of Patent: Oct. 14, 2003

(54) TWO-PIECE STEAM TURBINE NOZZLE BOX FEATURING A 360-DEGREE DISCHARGE NOZZLE

(75) Inventors: Thomas J. Farineau, Schenectady, NY (US); Michael T. Hamlin, Schenectady, NY (US); Robert W. Hausler, Schenectady, NY (US); Charles T. O'Clair, Schenectady, NY (US); Mark E. Braaten, Schenectady, NY (US); Dennis R. Ahl, Schenectady, NY (US); James Maughan, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/147,041

(22) Filed: May 17, 2002

(51) Int. Cl.[7] ..... F23D 14/48

(52) U.S. Cl. ..... 239/548; 239/556; 239/558; 415/191; 415/208.2

(58) Field of Search ..... 239/548, 567–568, 239/556–559; 415/191, 202, 208.2, 209.2, 210.1

(56) References Cited

U.S. PATENT DOCUMENTS

| | | | | | |
|---|---|---|---|---|---|
| 4,025,229 | A | * | 5/1977 | Browning et al. | 415/209.4 |
| 6,071,073 | A | * | 6/2000 | Maier | 415/150 |
| 6,196,793 | B1 | * | 3/2001 | Braaten | 415/191 |
| 6,302,644 | B1 | * | 10/2001 | Kukalj et al. | 415/155 |
| 6,416,277 | B1 | * | 7/2002 | Manges, Jr. | 415/189 |

* cited by examiner

*Primary Examiner*—Gregory L. Huson
*Assistant Examiner*—Amanda Flynn
(74) *Attorney, Agent, or Firm*—Nixon & Vanderhye PC

(57) ABSTRACT

A nozzle box includes first and second nozzle box halves which are bolted together. Each nozzle box half includes a nozzle ring segment that carries nozzles along its entire 180° arc, so that when the nozzle box halves are joined together a nozzle box is formed with no discontinuities of nozzles around its 360° circumference. The nozzles carried on each nozzle ring segment communicate with inlet ports, and associated passages which are perpendicular to the nozzle box exit plane.

6 Claims, 2 Drawing Sheets

TWO-PIECE STEAM TURBINE NOZZLE BOX FEATURING A 360-DEGREE DISCHARGE NOZZLE

FIELD OF THE INVENTION

The present invention relates to a horizontal-jointed, continuous nozzle ring for a steam turbine nozzle box.

BACKGROUND OF THE INVENTION

Nozzle Boxes generally accept steam at four distinct inlet ports. Typically, nozzle boxes are formed from two or more parts which are bolted together to form a complete nozzle box. Within each nozzle box part, steam is first redirected to flow in the axial direction and then accelerated about the axis of rotor rotation via nozzles located in the nozzle box exit plane. The nozzles are carried by a arcuate-shaped nozzle ring segment associated with each nozzle box part. The two nozzle box parts are bolted along their common horizontal joints so as to provide a rigid, stable structure during operation.

In prior art nozzle boxes, the structural thickness of the nozzle box horizontal joint was extended axially along the box and into each nozzle ring segment. This resulting discontinuity in the nozzle ring in the vicinity of the horizontal joint is illustrated at "A" in FIG. 4 which shows the toroidal portion of a nozzle ring in the vicinity of a horizontal joint (the toroidal portion of the nozzle ring as shown in FIG. 4 has been stretched out and depicted linearly to clearly illustrate this feature of the prior art). The associated disruption in nozzle air flow in the vicinity of the horizontal joint has proven to be detrimental to overall machine efficiency.

SUMMARY OF THE INVENTION

It is an object of the present invention to eliminate the nozzle ring horizontal joint interruption (flow blockage) typical of prior art-nozzle boxes. The present invention provides a nozzle box which increases full-load efficiency in steam turbines by employing nozzle ring segments continuously carrying nozzles, even at their respective horizontal joints, to thereby form a continuous 360° ring of nozzles.

Each nozzle box half is comprised of inlet nozzles and a toroidal portion. The toroidal portion comprises three segments, an inlet nozzle box segment, a transition bridge segment, and a nozzle ring segment. Each nozzle box half, is compatible with another nozzle box half so when assembled together a 360° ring of nozzles, without interruption at the horizontal joints, results. For each nozzle box half the nozzle ring segment is welded to the transition bridge segment, which is in turn welded to the inlet nozzle box segment.

Two nozzle box halves are then bolted together to form a complete nozzle box having a complete 360° ring of nozzles.

DETAILED DESCRIPTION OF THE INVENTION

Figure 1:
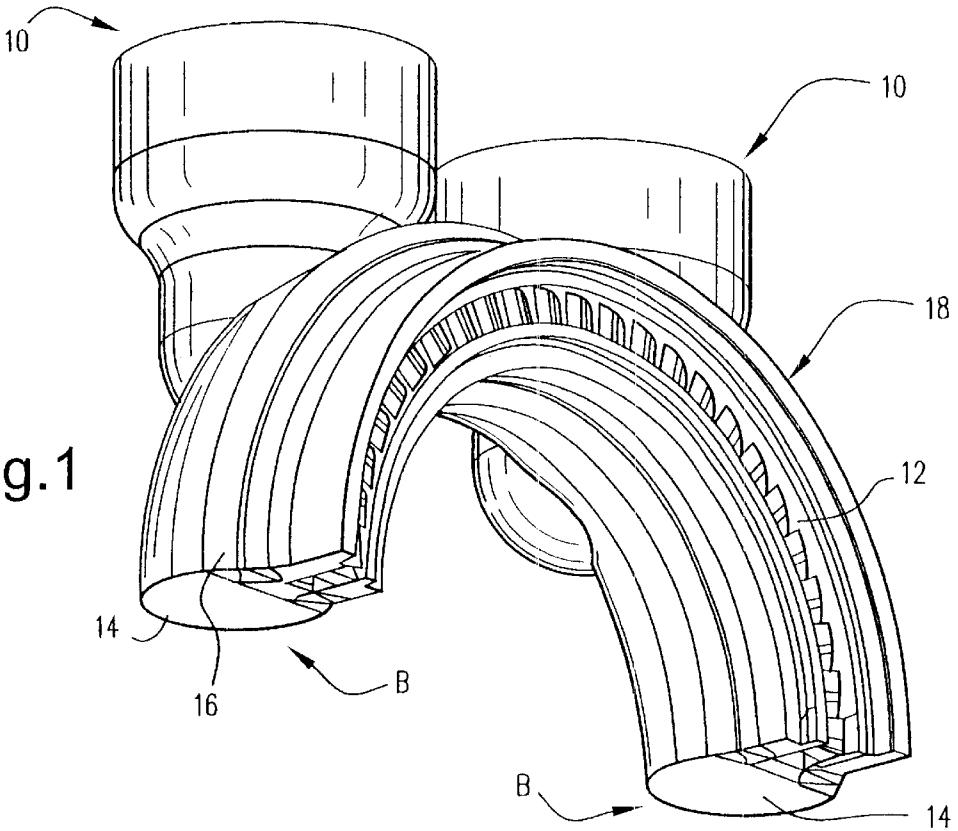
FIG. 1 shows an exemplary embodiment of a nozzle box half.

FIG. 1 shows one half of a nozzle box including inlet nozzles 10 and toroidal portion 18. Toroidal portion 18 includes inlet nozzle box segment 14, transition bridge segment 16, and nozzle ring segment 12. The inlet nozzles 10 communicate with toroidal portion 18 such that air flowing into inlet nozzles 10 is turned 900 and flows in turn through inlet nozzle box segment 14, transition bridge segment 16, and nozzle ring segment 12. Two nozzle box halves are joined at horizontal joints B to form a complete nozzle box.

A nozzle box having the above described structured components is disclosed in U.S. Pat. No. 6,196,793 B1 issued to Mark Edward Braaten and assigned to the General Electric Company. The teachings of U.S. Pat. No. 6,196,793 B1 are incorporated herein by reference.

Figure 2:
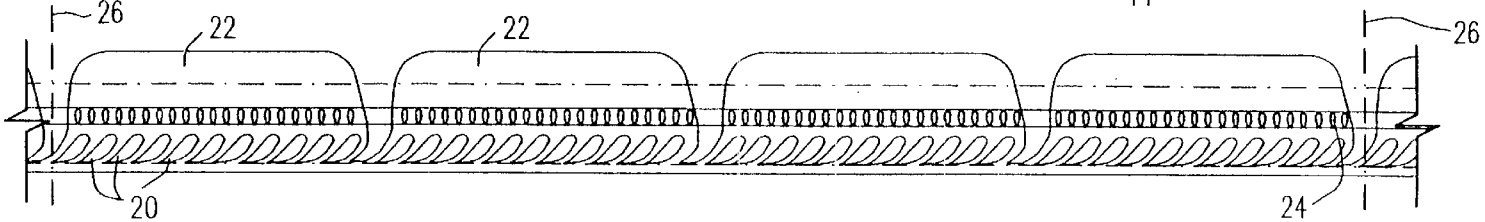
FIG. 2 schematically shows the toroidal portions of an assembled nozzle box stretched out linearly for easy reference to its features.
Figure 3:
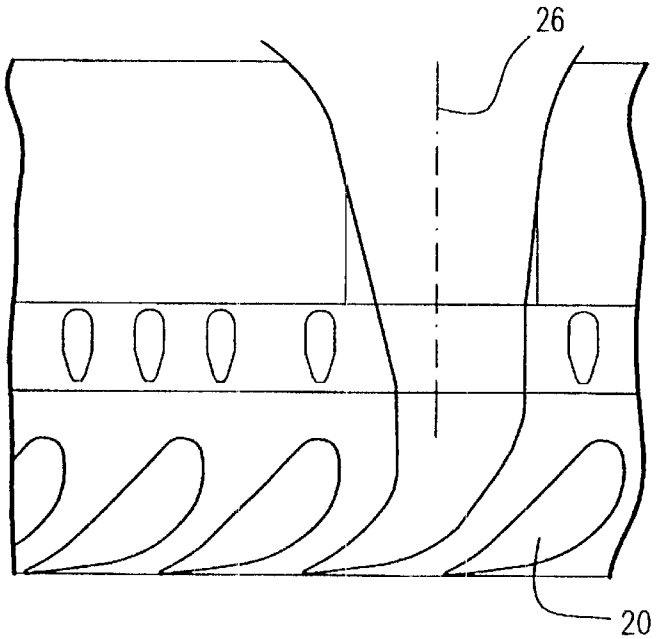
FIG. 3 shows an enlarged view of the horizontal joint shown in FIG. 2.

The invention, as shown in FIGS. 1–3, eliminates the traditional dead space from the nozzle box horizontal joint ends by replacing the end blocks with nozzle ring segments having nozzles welded completely along each respective 180° arc, even at the horizontal joints. The net result is an increase in control stage and overall steam turbine efficiency as well as a reduction in the dynamic bending stresses on the control stage buckets for both partial and full arc admissions. The admission angle is increased from 341° (typical) to 360° as a result.

Figure 4:
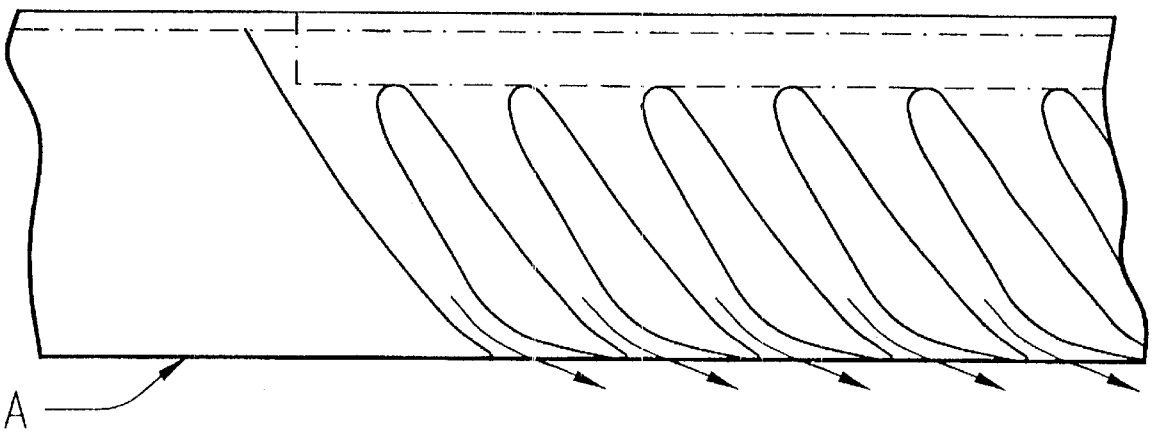
Fig.4 (PRIOR ART)
FIG. 4 schematically shows a toroidal portion of a stretched out prior art nozzle box in the vicinity of a horizontal joint.

Steam flow interruption at the horizontal joint, caused by the discontinuity of the partitions due to prior art ring fabrication and design is eliminated. As shown in FIG. 4, such prior art designs had no nozzles in the vicinity of the horizontal joint and thus there were two discontinuities of nozzles (about 180° apart) around the ring.

In the new horizontal-jointed nozzle box, as shown in FIGS. 1 and 2, there is a continuous ring of nozzles without any nozzle discontinuities at the horizontal joints. FIG. 2 shows the toroidal portion of the 360° nozzle ring stretched out linearly with nozzles 20 continuously disposed along the stretched out ring. In FIG. 2, the transition bridge segment is depicted by reference numeral 24, the inlet nozzle box segment is depicted by reference numeral 22, and the horizontal joints are depicted by reference numeral 26. The nozzle box halves are typically bolted together (not shown) at the horizontal joints 26.

FIG. 3 shows an enlarged view at the vicinity of a horizontal joint shown in FIG. 2. As shown in FIG. 3, the nozzle ring segment does not have any discontinuities of nozzles 20 at the horizontal joint 24.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle box for use in a steam turbine, said nozzle box comprising:

a first nozzle box half including a nozzle ring segment having a plurality of nozzles arranged in an 180° arc in a nozzle box exit plane, a transition bridge segment welded to said nozzle ring segment and an inlet nozzle box segment welded to said transition bridge segment;

a second nozzle box half including a nozzle ring segment having a plurality of nozzles arranged in an 180° arc in a nozzle box exit plane, a transition bridge segment welded to said nozzle ring segment and an inlet nozzle box segment welded to said transition bridge segment;

said first and second nozzle box halves having mating horizontal-joints at their ends so that when fitted together a continuous 360° ring of nozzles is formed in the nozzle box exit plane.

2. A nozzle box as claimed in claim 1, wherein said first and second nozzle box halves each include at least one inlet nozzle integrally formed with each one of said first and second inlet nozzle box segments.

3. A nozzle box as claimed in claim 2, wherein each one of said first and second inlet box segments redirect airflow from said at least one inlet by 90°.

4. A method of forming a nozzle box for use in a steam turbine, said method comprising:

forming a first nozzle box half including a nozzle ring segment having a plurality of nozzles arranged in an 180° arc in a nozzle box exit plane, a transition bridge segment welded to said nozzle ring segment and an inlet nozzle box segment welded to said transition bridge segment;

forming a second nozzle box half including a nozzle ring segment having a plurality of nozzles arranged in an 180° arc in a nozzle box exit plane, a transition bridge segment welded to said nozzle ring segment and an inlet nozzle box segment welded to said transition bridge segment;

joining said first and second nozzle box halves having mating horizontal-joints at their ends so that when fitted together a continuous 360° ring of nozzles is formed in the nozzle box exit plane.

5. The method as claimed in claim 4, wherein each one of said first and second nozzle box halves are formed to include at least one inlet.

6. The method as claimed in claim 5, wherein each of said first and second inlet box segments are formed to redirect airflow from said at least one inlet by 90°.

* * * * *

UNITED STATES PATENT AND TRADEMARK OFFICE

CERTIFICATE OF CORRECTION

PATENT NO. : 6,631,858 B1
DATED : October 14, 2003
INVENTOR(S) : Farineau et al.

It is certified that error appears in the above-identified patent and that said Letters Patent is hereby corrected as shown below:

Column 2,
Line 9, delete “900” and insert -- 90º --.

Signed and Sealed this

Twenty-seventh Day of January, 2004

JON W. DUDAS
*Acting Director of the United States Patent and Trademark Office*